US008897948B2

(12) United States Patent
Caveney et al.

(10) Patent No.: US 8,897,948 B2
(45) Date of Patent: Nov. 25, 2014

(54) SYSTEMS AND METHODS FOR ESTIMATING LOCAL TRAFFIC FLOW

(75) Inventors: Derek Stanley Caveney, Plymouth, MI (US); John Michael McNew, Ypsilanti, MI (US)

(73) Assignee: Toyota

( * ) Notice: Subject to any disclaimer, the term of this patent is extended or adjusted under 35 U.S.C. 154(b) by 844 days.

(21) Appl. No.: 12/890,751

(22) Filed: Sep. 27, 2010

(65) Prior Publication Data

US 2012/0078507 A1 Mar. 29, 2012

(51) Int. Cl.

| | |
|---|---|
| ***G07C 5/00*** | (2006.01) |
| ***G08G 1/0967*** | (2006.01) |
| ***G08G 1/16*** | (2006.01) |
| ***G08G 1/01*** | (2006.01) |

(52) U.S. Cl.

CPC ..... *G08G 1/0104* (2013.01); *G08G 1/096791* (2013.01); *G08G 1/162* (2013.01); *G08G 1/096725* (2013.01); *G08G 1/096716* (2013.01)

USPC ..... 701/29.1; 701/31.4; 701/96; 701/117; 701/424; 701/425; 340/438; 340/933; 340/988

(58) Field of Classification Search

None

See application file for complete search history.

(56) References Cited

U.S. PATENT DOCUMENTS

| | | | | |
|---|---|---|---|---|
| 6,081,763 | A * | 6/2000 | Smith et al. | 701/93 |
| 6,178,374 | B1 * | 1/2001 | Mohlenkamp et al. | 701/117 |
| 6,269,308 | B1 * | 7/2001 | Kodaka et al. | 701/301 |
| 6,480,102 | B1 * | 11/2002 | Miller et al. | 342/70 |
| 7,343,242 | B2 * | 3/2008 | Breitenberger et al. | 701/117 |
| 7,392,130 | B1 * | 6/2008 | Rosen et al. | 701/117 |
| 7,463,890 | B2 * | 12/2008 | Herz et al. | 455/445 |
| 7,609,176 | B2 * | 10/2009 | Yamane et al. | 340/994 |
| 7,613,564 | B2 * | 11/2009 | Vorona | 701/117 |
| 7,680,588 | B2 * | 3/2010 | Tsukamoto | 701/117 |
| 7,706,963 | B2 * | 4/2010 | Parikh et al. | 701/117 |
| 8,150,612 | B2 * | 4/2012 | Nagase et al. | 701/118 |
| 8,280,601 | B2 * | 10/2012 | Huang et al. | 701/70 |
| 8,428,843 | B2 * | 4/2013 | Lee et al. | 701/93 |
| 2003/0187571 | A1 | 10/2003 | Impson et al. | |
| 2004/0015291 | A1 * | 1/2004 | Petzold et al. | 701/202 |
| 2004/0088392 | A1 * | 5/2004 | Barrett et al. | 709/223 |
| 2005/0004753 | A1 * | 1/2005 | Weiland et al. | 701/208 |
| 2005/0228588 | A1 * | 10/2005 | Braeuchle et al. | 701/301 |
| 2006/0291633 | A1 * | 12/2006 | Glaza et al. | 379/112.02 |
| 2007/0100537 | A1 * | 5/2007 | Parikh et al. | 701/117 |
| 2007/0225894 | A1 * | 9/2007 | Tsukamoto | 701/117 |
| 2008/0140287 | A1 * | 6/2008 | Yang et al. | 701/45 |
| 2009/0115638 | A1 * | 5/2009 | Shankwitz et al. | 340/988 |
| 2009/0140887 | A1 | 6/2009 | Breed et al. | |

(Continued)

FOREIGN PATENT DOCUMENTS

| | | | | |
|---|---|---|---|---|
| GB | WO 2008/078088 | A1 | 7/2008 | |
| WO | WO 2010099789 | A1 * | 9/2010 | G01S 13/93 |

*Primary Examiner* — Jason Holloway
*Assistant Examiner* — Jonathan L Sample
(74) *Attorney, Agent, or Firm* — Dinsmore & Shohl LLP

(57) ABSTRACT

Systems and methods for estimating local traffic flow are described. One embodiment of a method includes determining a driving habit of a user from historical data, determining a current location of a vehicle that the user is driving, and determining a current driving condition for the vehicle. Some embodiments include predicting a desired driving condition from the driving habit and the current location, comparing the desired driving condition with the current driving condition to determine a traffic congestion level, and sending a signal that indicates the traffic congestion level.

20 Claims, 12 Drawing Sheets

(56) References Cited

U.S. PATENT DOCUMENTS

| | | | | |
|---|---|---|---|---|
| 2009/0299598 | A1* | 12/2009 | Boecker et al. | 701/96 |
| 2010/0042282 | A1* | 2/2010 | Taguchi et al. | 701/25 |
| 2010/0076675 | A1 | 3/2010 | Barth et al. | |
| 2010/0082195 | A1* | 4/2010 | Lee et al. | 701/25 |
| 2010/0198478 | A1* | 8/2010 | Shin | 701/96 |
| 2010/0209885 | A1* | 8/2010 | Chin et al. | 434/65 |
| 2010/0274435 | A1* | 10/2010 | Kondoh et al. | 701/29 |
| 2010/0312527 | A1* | 12/2010 | Weiland et al. | 703/1 |
| 2011/0035146 | A1* | 2/2011 | Guha et al. | 701/201 |
| 2011/0098886 | A1* | 4/2011 | Deng | 701/41 |
| 2011/0313665 | A1* | 12/2011 | Lueke et al. | 701/301 |
| 2012/0143395 | A1* | 6/2012 | Yamada et al. | 701/1 |

* cited by examiner

SYSTEMS AND METHODS FOR ESTIMATING LOCAL TRAFFIC FLOW

TECHNICAL FIELD

Embodiments described herein generally relate to determining traffic flow by probe vehicles and, more specifically, to facilitating communication between vehicles on roadways to more accurately determine traffic flow and identify traffic situations.

BACKGROUND

Various approaches currently exist to estimate traffic flow on roadways. Historically, this estimation has been performed through infrastructure solutions, such as magnetic induction loops, which are embedded in the roadway surface or signal processing of data from radars or cameras, which are strategically placed with a good field of view of view above the roadway. While these solutions are often capable of determining traffic flow on a macro level (e.g., on the order of miles/kilometers of roadway), they are often deficient in providing more localized traffic conditions (e.g., on the order of hundreds of yards/meters of roadway). Accordingly, certain traffic conditions may be missed by current solutions.

SUMMARY

Included are embodiments for estimation of local traffic flow by probe vehicles. According to one embodiment, a method for estimation of local traffic flow by probe vehicles includes determining a driving habit of a user from historical data, determining a current location of a vehicle that the user is driving, and determining a current driving condition for the vehicle. Some embodiments include predicting a desired driving condition from the driving habit and the current location, comparing the desired driving condition with the current driving condition to determine a traffic congestion level, and sending a signal that indicates the traffic congestion level.

In another embodiment, a system for estimation of local traffic flow by probe vehicles includes a memory component that stores vehicle environment logic that causes a vehicle computing device of a vehicle that a user is driving to determine a driving habit of the user from historical data, determine a current location of the vehicle, and determine a current driving condition for the vehicle. In some embodiments, the vehicle environment logic is configured to predict a desired driving condition from the driving habit and the current location, compare the desired driving condition with the current driving condition to determine a traffic congestion level, and send a signal that indicates the traffic congestion level.

In yet another embodiment, a non-transitory computer-readable medium for estimation of local traffic flow by probe vehicles includes a program that, when executed by a vehicle computing device of a vehicle, causes the computer to determine, by a computing device, a driving habit of a user from historical data, determine a current location of the vehicle that the user is driving, and determine a current driving condition for the vehicle. In some embodiments, the program is configured to predict a desired driving condition from the driving habit and the current location, compare the desired driving condition with the current driving condition to determine a traffic congestion level, and send a signal that indicates the traffic congestion level.

These and additional features provided by the embodiments of the present disclosure will be more fully understood in view of the following detailed description, in conjunction with the drawings.

BRIEF DESCRIPTION OF THE DRAWINGS

The embodiments set forth in the drawings are illustrative and exemplary in nature and not intended to limit the disclosure. The following detailed description of the illustrative embodiments can be understood when read in conjunction with the following drawings, where like structure is indicated with like reference numerals and in which.

DETAILED DESCRIPTION

Embodiments disclosed herein include systems, methods, and non-transitory computer-readable mediums for estimating local traffic flow. More specifically, in some embodiments, the traffic flow is estimated via a comparison of current vehicle speed with a posted speed limit. Similarly, in some embodiments, a desired vehicle speed may be determined and compared with a current speed of the vehicle. In some embodiments, mobility factors can be determined and compared with desired mobility conditions for a particular user. From these traffic flow determinations, the probe vehicle can communicate with other vehicles on the road to indicate traffic congestion.

Figure 1:
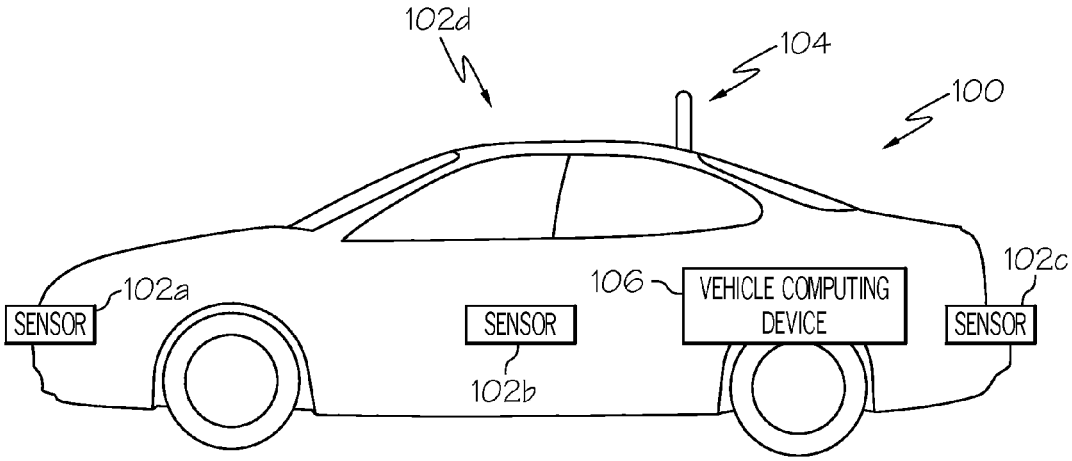
FIG. 1 schematically depicts a probe vehicle that may be used for determining local traffic flow, according to embodiments disclosed herein.

Referring now to the drawings, FIG. 1 schematically depicts a probe vehicle 100 that may be used for determining local traffic flow, according to embodiments disclosed herein. As illustrated, the probe vehicle 100 may include one or more sensors 102*a*, 102*b*, 102*c*, and 102*d* (where the sensor 102*d* is located on the opposite side of the vehicle 100 as the sensor 102*b* and the sensors 102*a*-102*d* are collectively referred to as "sensors 102"), a wireless communications device 104, and a vehicle computing device 106. The sensors 102 may include radar sensors, cameras, lasers, and/or other types of sensors that are configured to determine the presence of other vehicles in the proximity of the probe vehicle 100. Additionally, while the sensors 102 may include sensors specifically designed for sensing traffic congestion, in some embodiments, the sensors 102 may also be used for parking assistance, cruise control assistance, rear view assistance, and the like.

Similarly, the wireless communications device 104 may be configured as an antenna for radio communications, cellular communications satellite communications, and the like. Similarly, the wireless communications device 104 may be configured exclusively for communication with other vehicles within a predetermined range. While the wireless communications device 104 is illustrated in FIG. 1 as an external antenna, it should be understood that this is merely an example, as some embodiments may be configured with an internal antenna or without an antenna at all.

Figure 2:
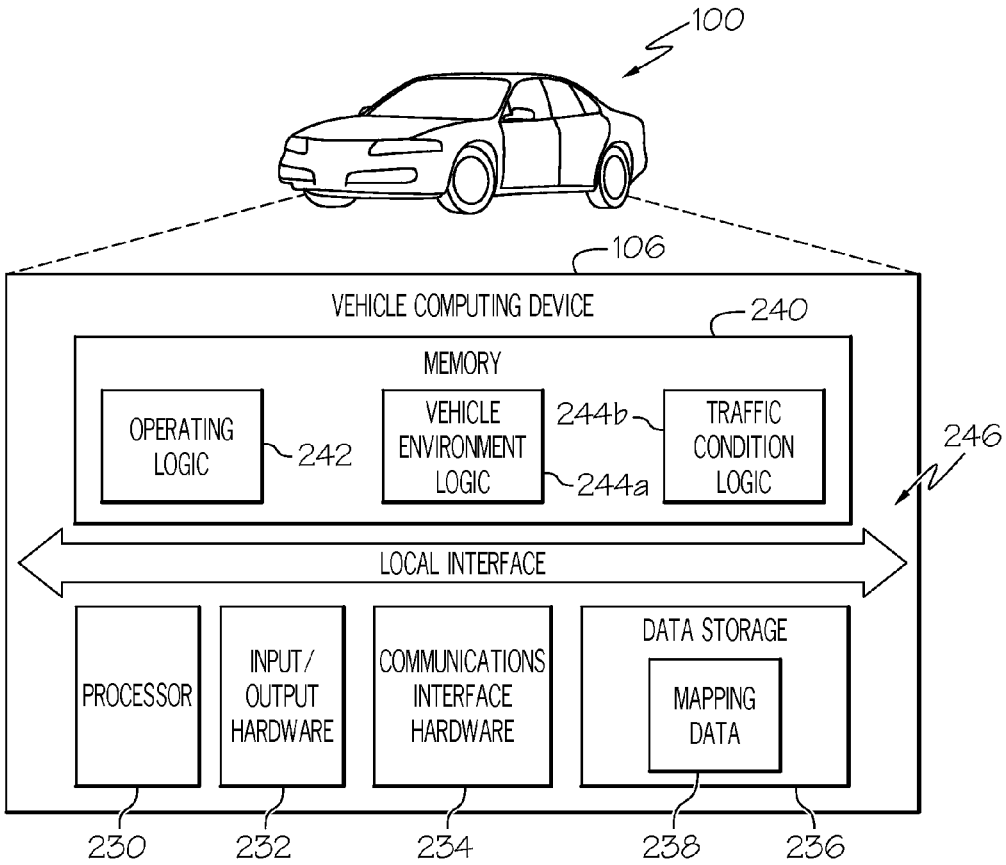
FIG. 2 schematically depicts a computing device that may be configured to determine local traffic flow, according to embodiments disclosed herein.

FIG. 2 schematically depicts the vehicle computing device 106 that may be configured to determine local traffic flow, according to embodiments disclosed herein. In the illustrated embodiment, the vehicle computing device 106 includes a processor 230, input/output hardware 232, network interface hardware 234, a data storage component 236 (which stores mapping data 238), and a memory component 240. The memory component 240 may be configured as volatile and/or nonvolatile memory and, as such, may include random access memory (including SRAM, DRAM, and/or other types of RAM), flash memory, registers, compact discs (CD), digital versatile discs (DVD), and/or other types of non-transitory computer-readable mediums. Depending on the particular embodiment, these non-transitory computer-readable mediums may reside within the vehicle computing device 106 and/or external to the vehicle computing device 106.

Additionally, the memory component 240 may be configured to store operating logic 242, vehicle environment logic 244*a*, and traffic condition logic 244*b*, each of which may be embodied as a computer program, firmware, and/or hardware, as an example. A local interface 246 is also included in FIG. 2 and may be implemented as a bus or other interface to facilitate communication among the components of the vehicle computing device 106.

The processor 230 may include any processing component operable to receive and execute instructions (such as from the data storage component 236 and/or memory component 240). The input/output hardware 232 may include a monitor, keyboard, mouse, printer, camera, microphone, speaker, and/or other device for receiving, sending, and/or presenting data. The network interface hardware 234 may be configured for communicating with any wired or wireless networking hardware, such as the wireless communications device 104 or other antenna, a modem, LAN port, wireless fidelity (Wi-Fi) card, WiMax card, mobile communications hardware, and/or other hardware for communicating with other networks and/or devices. From this connection, communication may be facilitated between the vehicle computing device 106 and other computing devices, which may or may not be associated with other vehicles.

Similarly, it should be understood that the data storage component 236 may reside local to and/or remote from the vehicle computing device 106 and may be configured to store one or more pieces of data for access by the vehicle computing device 106 and/or other components. As illustrated in FIG. 2, the data storage component 236 stores mapping data 238, which in some embodiments includes data related to roads, road positions posted speed limits, construction sites, as well as routing algorithms for routing the probe vehicle 100 to a desired destination location.

Included in the memory component 240 are the operating logic 242, the vehicle environment logic 244*a*, and the traffic condition logic 244*b*. The operating logic 242 may include an operating system and/or other software for managing components of the probe vehicle 100. Similarly, the vehicle environment logic 244*a* may reside in the memory component 240 and may be configured to cause the processor 230 to receive signals from the sensors 102 and determine traffic congestion in the proximity of the probe vehicle 100. The traffic condition logic 244*b* may be configured to cause the processor 230 to receive data from other probe vehicles regarding traffic conditions in the proximity of the probe vehicle 100 and provide an indication of the relevant traffic conditions that the probe vehicle 100 has yet to encounter.

It should be understood that the components illustrated in FIG. 2 are merely exemplary and are not intended to limit the scope of this disclosure. While the components in FIG. 2 are illustrated as residing within the probe vehicle 100, this is merely an example. In some embodiments, one or more of the components may reside external to the probe vehicle 100. It should also be understood that, while the vehicle computing device 106 in FIGS. 1 and 2 is illustrated as a single system, this is also merely an example. In some embodiments, the vehicle environment functionality is implemented separately from the traffic condition functionality, which may be implemented with separate hardware, software, and/or firmware.

Figure 3A:
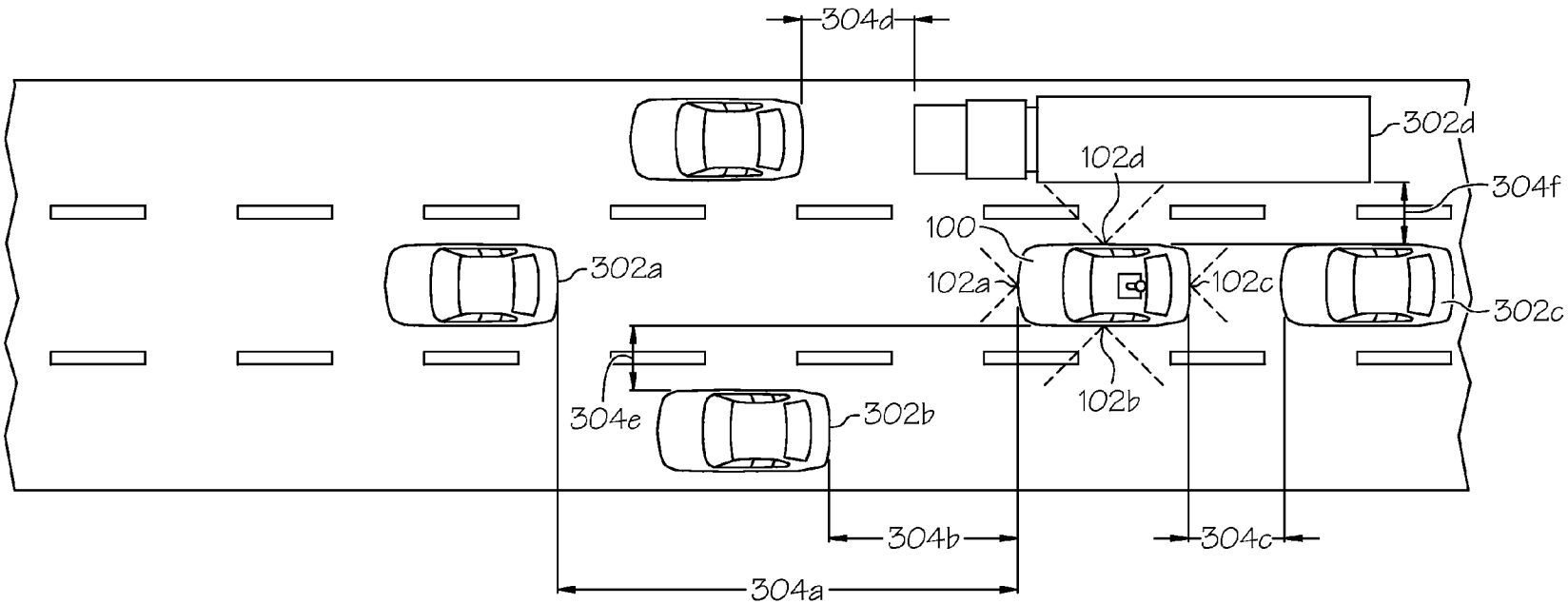
FIGS. 3A-3C schematically depict a plurality of traffic conditions that may be encountered by a probe vehicle, according to embodiments disclosed herein.
Figure 3B:
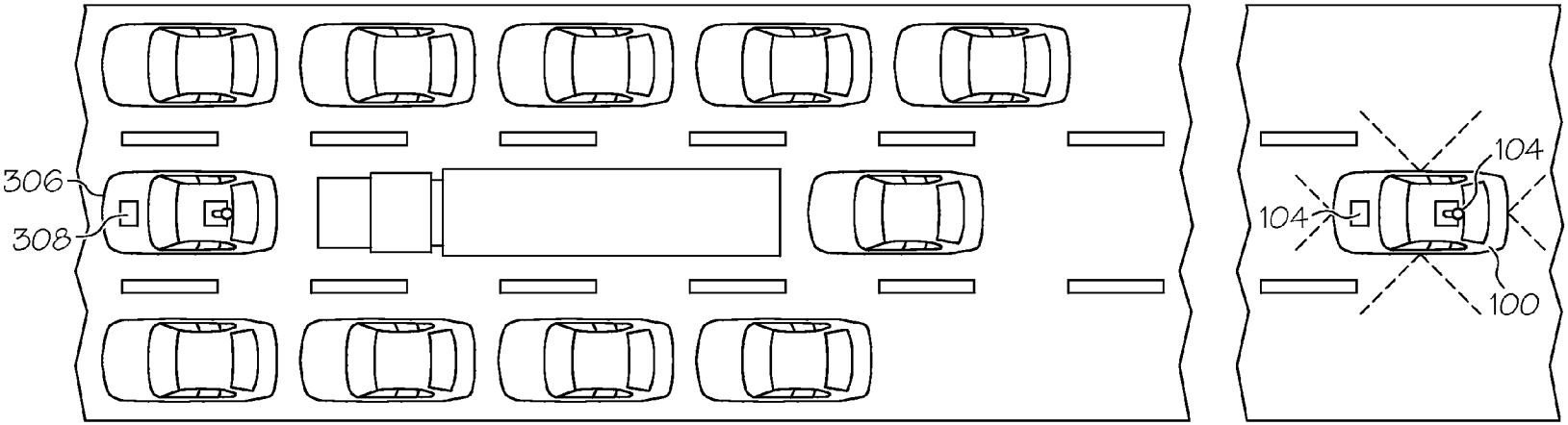
Figure 3C:
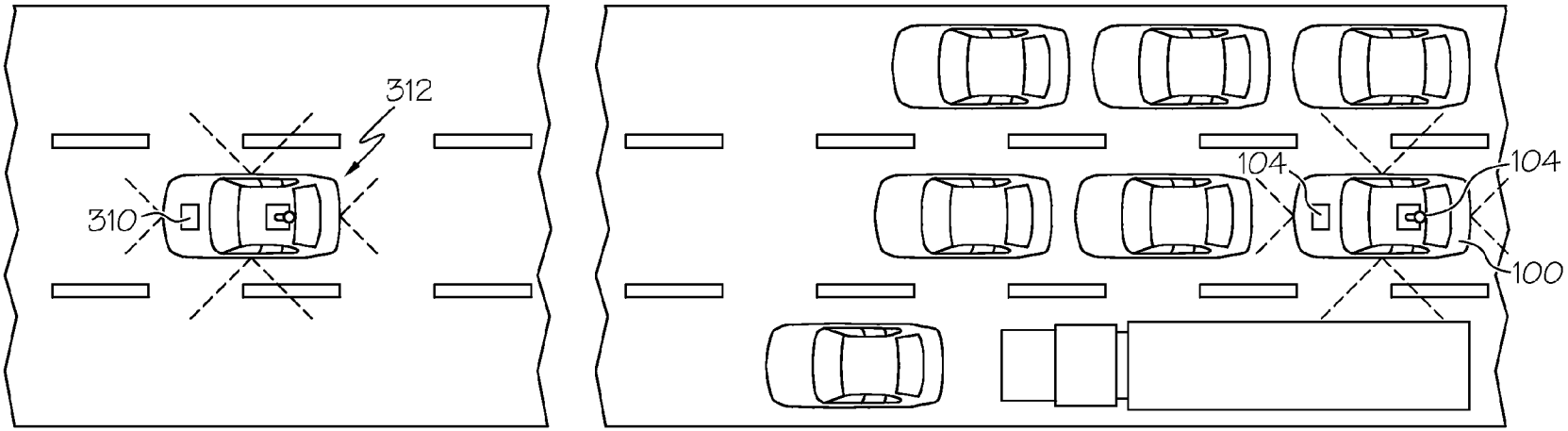

Referring now to FIGS. 3A-3C, a plurality of traffic conditions that may be encountered by a probe vehicle, are schematically depicted, according to embodiments disclosed herein. As illustrated in FIG. 3A, the probe vehicle 100 may be traveling down a roadway, with one or more other vehicles 302*a*, 302*b*, 302*c*, and 302*d* (collectively referred to as "other vehicles 302"). Accordingly, the sensors 102 may be configured to determine the location of the other vehicles 302 in relation to the probe vehicle 100. With this information, the vehicle computing device 106 can determine on or more traffic gaps 304*a*-304*f* (collectively referred to as "traffic gaps 304") for determining a traffic congestion level. More specifically, in the example of FIG. 3A, the sensor 102*a* can detect the other vehicle 302*a* and determine a distance between the probe vehicle 100 and the other vehicle 302*a*, as traffic gap 304*a*. Similarly, the sensor 102*b* can detect a position of the other vehicle 302*b*, and thus determine the traffic gaps 304*b* and 304*e*. The sensor 102*c* can detect the other vehicle 302*c*, and thus determine the traffic gap 304*c*. Similarly, the sensor 102*d* can detect the presence of the other vehicle 302*d*, and thus determine the traffic gaps 304*d* and 304*f*.

Similarly, FIG. 3B illustrates an example of a first vehicle (e.g., probe vehicle 100) receiving traffic information from a second vehicle 306. In the example of FIG. 3B, the second vehicle 306 is equipped with a second vehicle computing device 308 and includes the traffic detecting hardware and software described with respect to FIGS. 1 and 2. Accordingly, the second vehicle computing device 308 can determine that the second vehicle 306 (which may also be configured as a probe vehicle) is currently in a shockwave (where a group of other vehicles are suddenly stopped on a fast moving roadway) or other traffic incident, where vehicle traffic speed rapidly declines to zero or almost zero. Accordingly, the second vehicle 306 can transmit data indicating the position of the second vehicle 306, the current speed of the second vehicle 306, and/or other data to indicate that the second vehicle is currently in a shockwave. The first vehicle (e.g. probe vehicle 100 from FIGS. 1 and 2) can receive the data from the second vehicle 306 and indicate to a user of the first vehicle that a potentially dangerous situation is approaching. Similarly, in some embodiments, other mechanisms may be implemented by the first vehicle, such as automatic speed reduction, to further prevent the first vehicle from approaching the traffic incident at potentially dangerous speeds.

FIG. 3C illustrates an example of the probe vehicle 100 being stopped in a shockwave. In such a situation, the user of the probe vehicle 100 may want to know whether the shockwave will end soon. Accordingly, the vehicle computing device 106 can receive traffic data from a third vehicle computing device 310 of a third vehicle 312. The third vehicle computing device 310 can indicate the position of the third vehicle 312, thus indicating to the vehicle computing device 106 where the shockwave ends.

It should be understood that while the embodiments described herein with regard to FIGS. 3B-3C refer to a shockwave, this is merely an example. More specifically, other types of traffic incidents, such as construction, traffic accidents, and the like may also be included within the scope of this disclosure.

Figure 4:
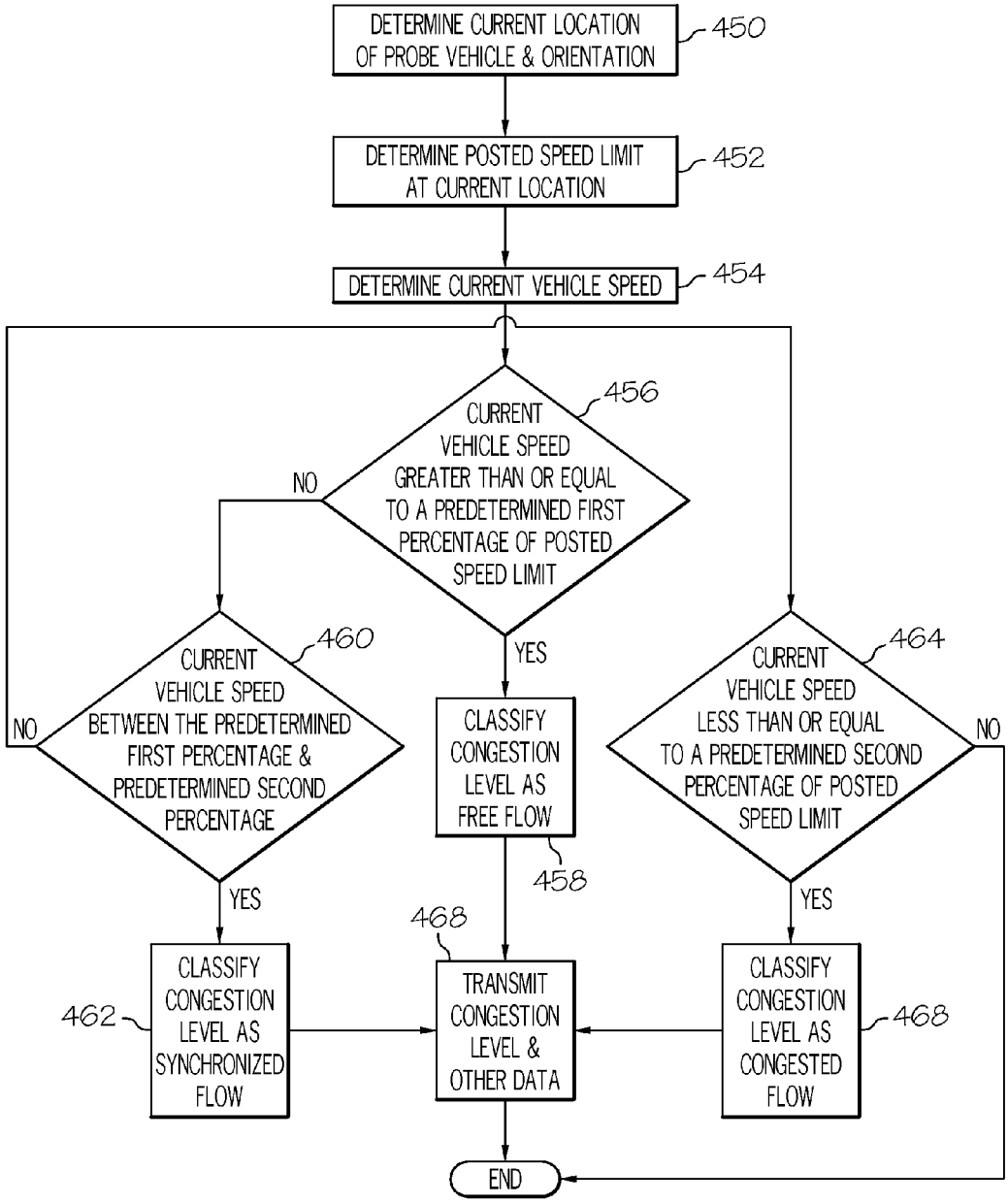
FIG. 4 depicts a flowchart for determining a traffic congestion level from current vehicle speed, according to embodiments disclosed herein.

FIG. 4 depicts a flowchart for determining a traffic congestion level from current vehicle speed, according to embodiments disclosed herein. As illustrated, the vehicle computing device 106 can determine a current location and orientation of the probe vehicle (block 450). This information can be obtained via a global positioning system (GPS) receiver and/or via other position determining components that may be part of the vehicle environment logic 244*b* and/or the vehicle computing device 106. Additionally, a posted speed limit of the roadway at the determined position may be determined (block 452). The posted speed limit may be determined from the mapping data 238 (FIG. 2) and/or may be determined via communication with a remote computing device.

Additionally, a current driving condition, such as vehicle speed may also be determined (block 454). The vehicle speed may be determined via communication with a speedometer in the probe vehicle 100, via a calculation of the change in global position over time, and/or via other mechanisms. A determination can then be made regarding whether the current vehicle speed is greater than or equal to a predetermined first percentage of the posted speed limit (block 456). If the current speed is greater than the predetermined first percentage of the posted speed limit, the congestion level can be classified as "free flow." For example, if the first predetermined percentage is selected to be 85%, and the current vehicle speed is 90% of the posted speed limit, a determination can be made that the traffic congestion is minimal, and such that the congestion flow level is classified as "free flow."

If, at block 456, the current vehicle speed is not greater than or equal to a predetermined percentage of the posted speed limit, a determination can be made regarding whether the current vehicle speed is between the first predetermined percentage and a second predetermined percentage of the posted speed limit. For example, if the first predetermined percentage is 75%, the second predetermined percentage is 50%, and the current vehicle speed is 60% of the posted speed limit, the flowchart can proceed to block 462 to classify the congestion level as "synchronized flow." If, at block 460, the current speed is not between the first predetermined percentage and the second predetermined percentage, a determination can be made whether the current vehicle speed is less than or equal to the second predetermined percentage (block 464). If so, the congestion level can be classified as "congested flow" (block 466). From blocks 462, 458, and 466, the determined congestion level and/or other data can be transmitted from the probe vehicle 100 to other vehicles (block 468).

Figure 5:
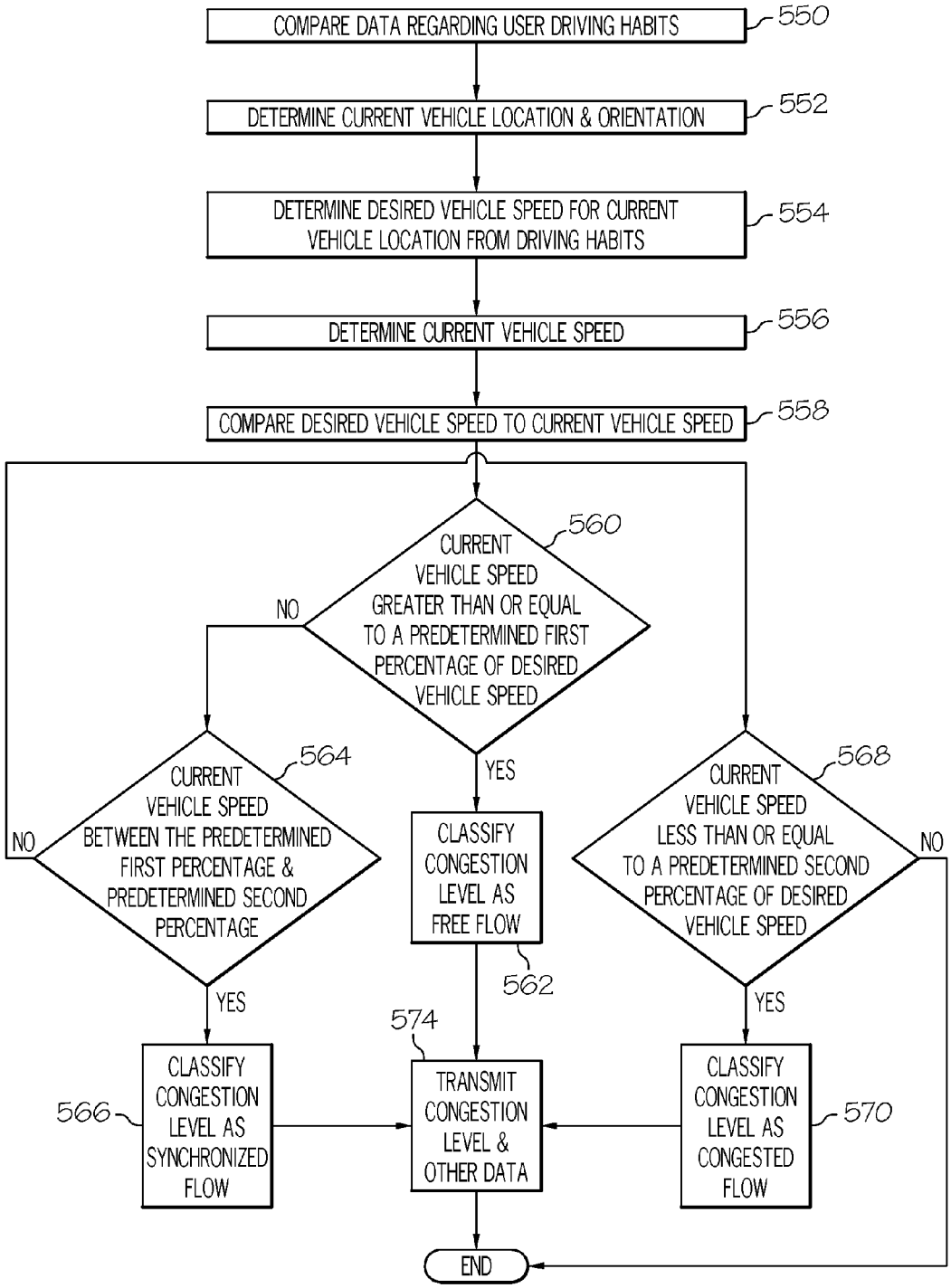
FIG. 5 depicts a flowchart for determining a traffic congestion level from a predicted desired vehicle speed, according to embodiments disclosed herein.

Referring now to FIG. 5, a flowchart is depicted for determining a traffic congestion level from a predicted desired vehicle speed the user wishes to drive, according to embodiments disclosed herein. As illustrated, the vehicle computing device 106 (via the vehicle environment logic 244*a*) can compile historical data regarding a user's driving habits (block 550). More specifically, the vehicle computing device 106 may be configured to compile driving data to predict a general preferred driving speed, a preferred driving speed for a particular roadway, a preferred driving speed for a particular speed limit, a preferred cruise control speed, a preferred lane change frequency, a preferred headway distance, a preferred lane change space, and/or other data. Next, the vehicle computing device 106 can determine the current location and orientation (e.g., direction of travel) for the probe vehicle 100 (block 552). A desired driving condition, such as desired vehicle speed, can then be determined based on the user driving habits (block 554). A determination can be made regarding a current driving condition, such as the current vehicle speed (block 556). The vehicle computing device 106 can then compare the desired driving condition (e.g., desired vehicle speed) to the current driving condition (e.g., current vehicle speed), as shown in block 558.

A determination can be made regarding whether the current vehicle speed is greater than or equal to a predetermined first percentage of the desired vehicle speed (block 560). If so, the vehicle computing device 106 can classify the congestion level as "free flow" (block 562). If, at block 560, the current vehicle speed is not greater than or equal to a first predetermined percentage of the desired vehicle speed, a determination can be made regarding whether the current vehicle speed is between the first predetermined percentage of desired vehicle speed and a second predetermined percentage of desired vehicle speed (block 564). If so, the congestion level can be classified as "congested flow" (block 566). If not, a determination can be made regarding whether the current vehicle speed is less than or equal to the second predetermined percentage of desired vehicle speed (block 568). If so, the congestion level can be classified as "congested flow" (block 570). From blocks 564, 570, and 572, the congestion level and/or other data can be transmitted to other vehicles (block 574).

Figure 6A:
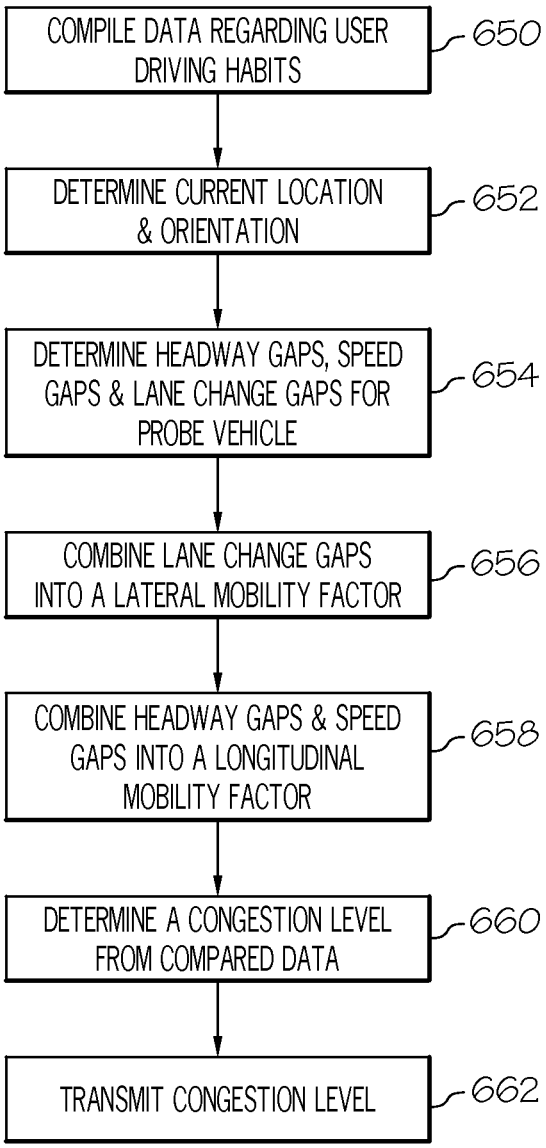
FIGS. 6A-6C depict a flowchart for determining a traffic congestion level from user specific driving preferences, according to various embodiments disclosed herein.
Figure 6B:
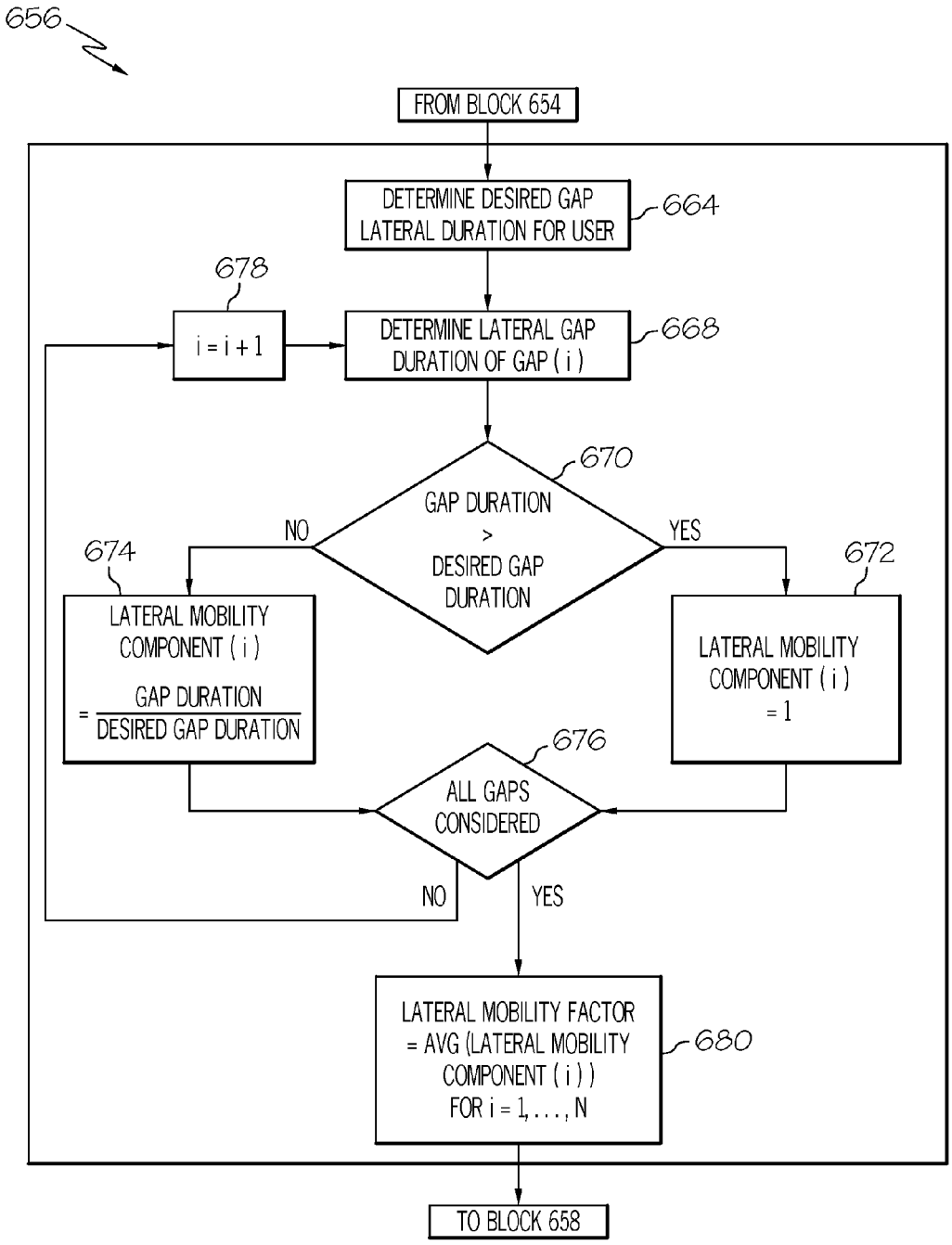
Figure 6C:
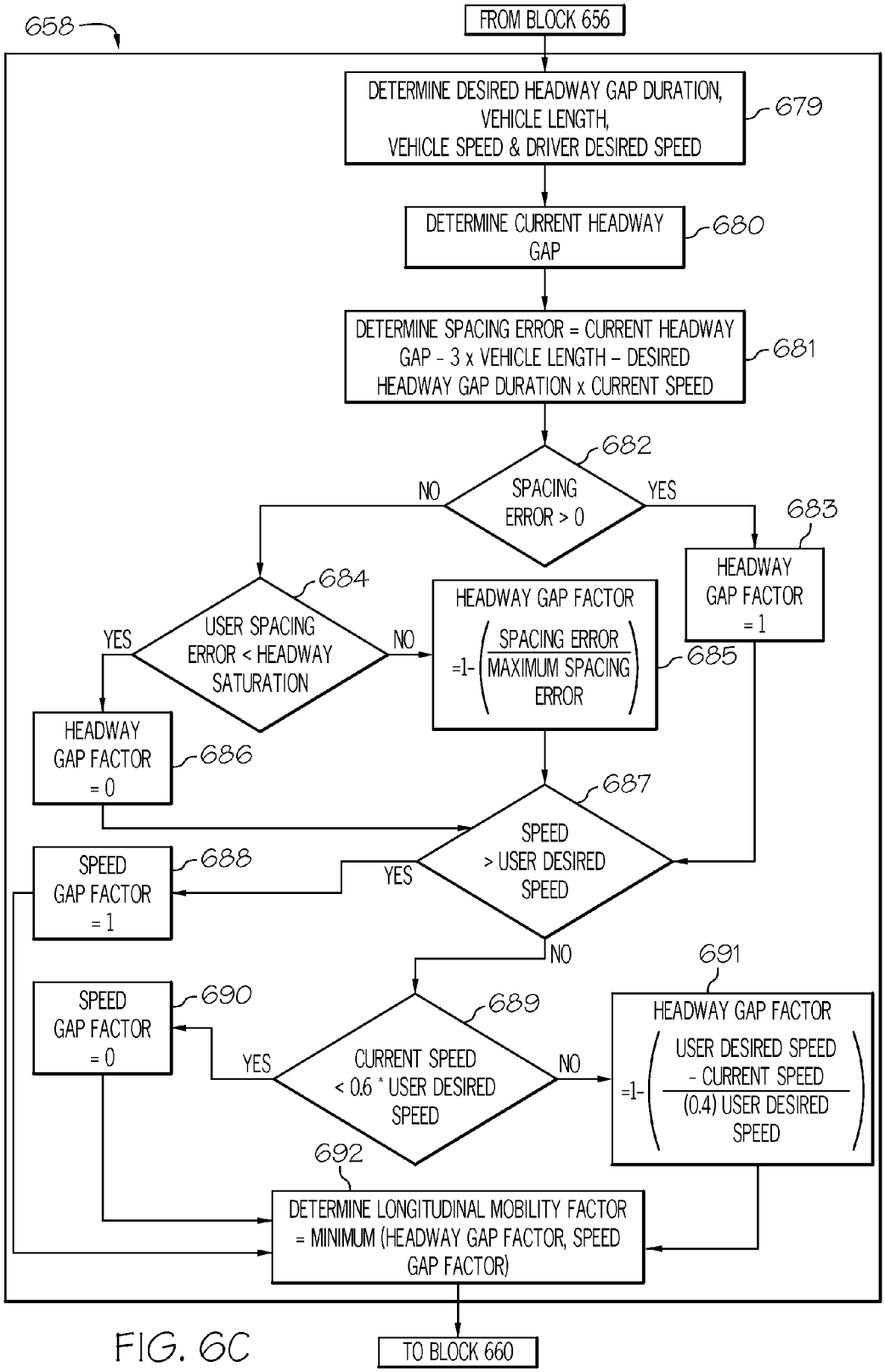

Referring now to FIGS. 6A-6C flowchart is depicted for determining a traffic congestion level from user specific driving preferences, according to various embodiments disclosed herein. As illustrated in FIG. 6A, the vehicle computing device 106 (FIGS. 1, 2) can compile data regarding user driving habits (block 650). As discussed with regard to FIG. 5, the user driving habits can include preferred driving speed, preferred driving speed for a particular roadway, preferred driving speed for a particular speed limit, preferred cruise control speed, preferred lane change frequency, preferred headway distance, preferred lane change space, and/or other data. Additionally, a current location and orientation of the probe vehicle 100 can be determined (block 652). A current driving condition, such as one or more current headway gaps, one or more current velocity gaps, and a current lateral gap (or gaps), such as lane change gaps may also be determined for the probe vehicle (block 654). The lane change gaps may be combined for calculating a lateral mobility factor (block 656). The headway gaps and velocity gaps may be combined into a longitudinal mobility factor (block 658). A congestion level may be determined from the compared data (block 660). Additionally, the congestion level can be transmitted to other vehicles (block 662).

FIG. 6B expands on block 656 in FIG. 6A, related to determining a lateral mobility factor. More specifically, a determination can be made regarding a desired gap duration, including a time duration and/or a length duration (block 664). While not a requirement, this may be performed by accessing the compiled data from block 650. Additionally, a lateral gap duration of gap(i) can be determined, where i=1 (block 668). More specifically, similar to FIG. 3A, the probe vehicle 100 may indentify one or more gaps on the roadway that the probe vehicle is traveling. A determination can then be made regarding whether the lateral gap duration of gap(i) is greater than a desired gap duration for the user (block 670). If so, a lateral mobility factor component(i) can be set equal to 1 (block 672). If, at block 670, the lateral gap duration of gap(i) is not greater than the desired gap duration, the lateral mobility factor component(i) may be set equal to the gap duration(i) divided by the desired gap duration (block 674). Additionally, from blocks 672 and 674, a determination can be made regarding whether all gaps are considered. If not, the flowchart can proceed to 678 to increment i by 1, and the process can restart. If all gaps have been considered, the lateral mobility factor can be determined as the average of the mobility factor components for each of the gaps i, from 1 to N (block 680). The lateral mobility factor may represent an amount that the current lateral driving condition fails to meet the desired lateral driving condition. The process may then proceed to block 658 in FIG. 6A.

FIG. 6C illustrates block 658 from FIG. 6A in more detail. More specifically, from block 656, desired driving conditions, such as desired headway, gap duration, desired velocity gap duration, vehicle length, vehicle velocity, and driver desired speed may be determined (block 679). Again, while not a requirement, this may have been performed in block 650 of FIG. 6A. A current headway gap may also be determined (block 680). Next, a spacing error may be determined by adding the current headway gap to three times vehicle length, minus the desired headway gap times current velocity, or:

SpacingError=CurrentHeadwayGap+(3)(VehicleLength) −(DesiredHeadwayGap)(CurrentVelocity)

A determination can then be made regarding whether the spacing error is greater than 0 (block 682). If so, the headway gap factor is set equal to 1 (block 683). If the spacing error is not greater than 0, a determination can be made regarding whether the spacing error is less than a user headway saturation, which is the minimum headway distance that the user can tolerate (block 684). If so, the headway gap factor can be set equal to zero (block 686). If, at block 684, the spacing error is determined to not be less than headway saturation, headway gap factor can be determined as 1 minus the spacing error, divided by the user headway saturation, or:

$$HeadwayGapFactor = 1 - \frac{SpacingError}{UserHeadwaySaturation}.$$

From blocks 683, 685, and 686, a determination can be made regarding whether the current velocity is greater than the desired user velocity (block 687). If so, the velocity gap factor is set equal to 1 (block 688). If the current velocity is not greater than the desired user velocity, a determination can be made regarding whether the current velocity is less than, for example, 0.6 multiplied by the user desired velocity (block 689). If so, the velocity gap factor is set equal to zero (block 690). If the current velocity is not less than 0.6 times the user desired velocity, the velocity gap factor may be set to 1 minus user desired velocity minus current velocity, divided by 0.4 multiplied by user desired velocity, or:

$$VelocityGapFactor = 1 - \frac{UserDesiredVelocity - CurrentVelocity}{(0.4)UserDesiredVelocity}.$$

From blocks 688, 690, and 691, the longitudinal mobility factor can be set as the minimum of the headway gap factor and the velocity gap factor and may represent an amount that the current driving conditions fail to meet the desired driving conditions (block 692). The flowchart may then proceed to block 660, in FIG. 6A.

Figure 7:
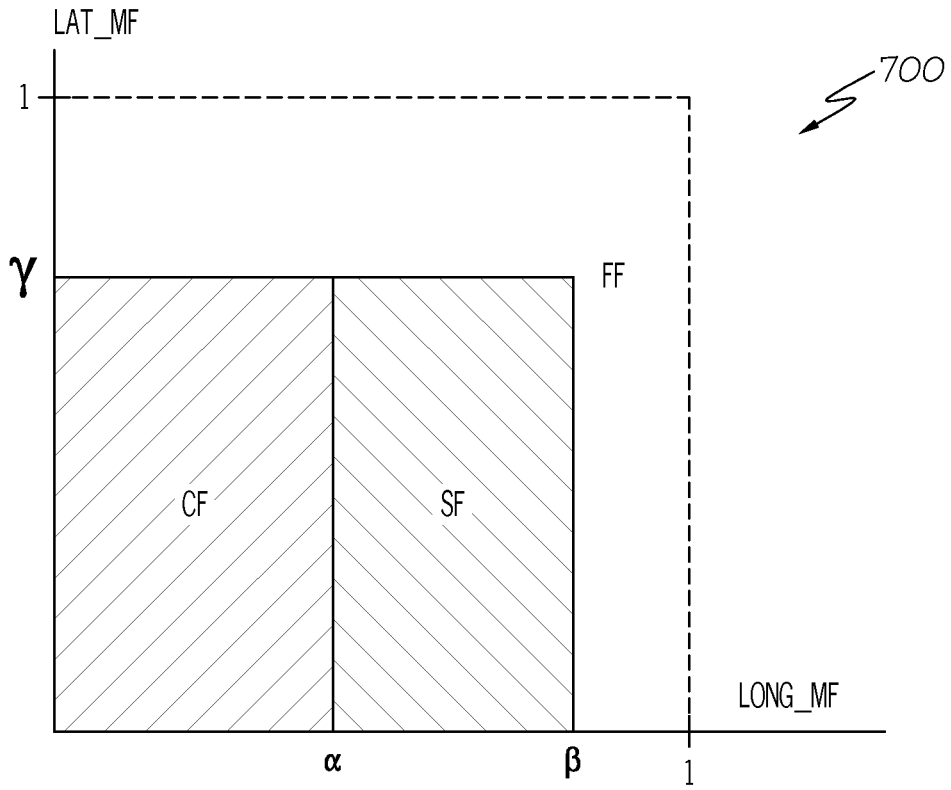
FIG. 7 depicts a graph illustrating exemplary conditions for classifying traffic congestion, according to embodiments disclosed herein.

Referring now to FIG. 7 a graph is depicted, illustrating a graph 700 with exemplary conditions for classifying traffic congestion, according to embodiments disclosed herein. More specifically, from block 660 in FIG. 6A, a determination can be made regarding the current congestion level. In the example of FIG. 7, a determination of congestion level can be made from the determined lateral mobility factor and the longitudinal mobility factor. As illustrated in the graph 700, the congestion level can be determined to be "free flow" (FF) if the lateral mobility factor is between the predetermined thresholds of $\gamma$ and 1 or if the longitudinal mobility factor is between the predetermined thresholds of $\beta$ and 1. Similarly, if the lateral mobility factor is less than the predetermined threshold of $\gamma$, the congestion level will be determined to be "congested flow," if the longitudinal mobility factor is less than the predetermined threshold of $\alpha$ and "synchronized flow," if the longitudinal mobility factor is between the predetermined thresholds of $\alpha$ and $\beta$.

Figure 8A:
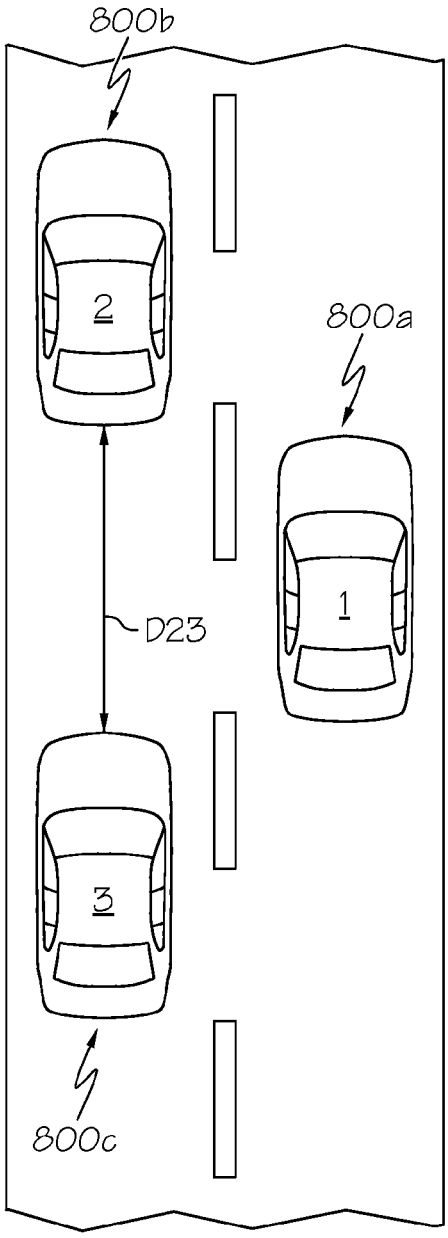
FIGS. 8A-8C depict another exemplary embodiment for determining traffic congestion, according to embodiments disclosed herein.
Figure 8B:
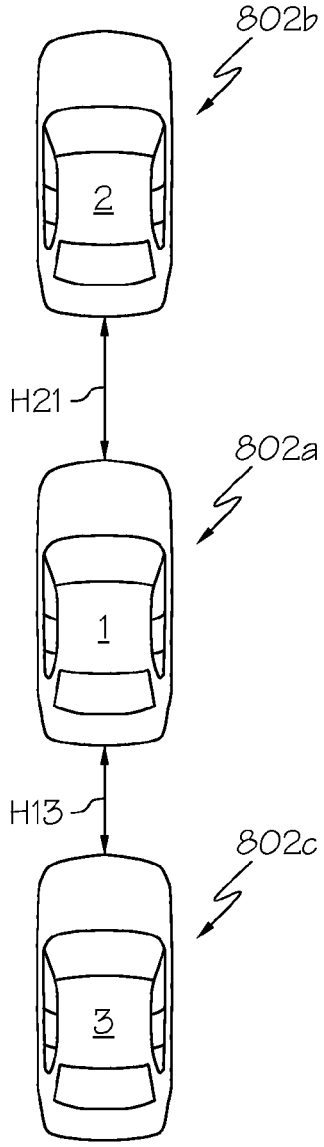
Figure 8C:
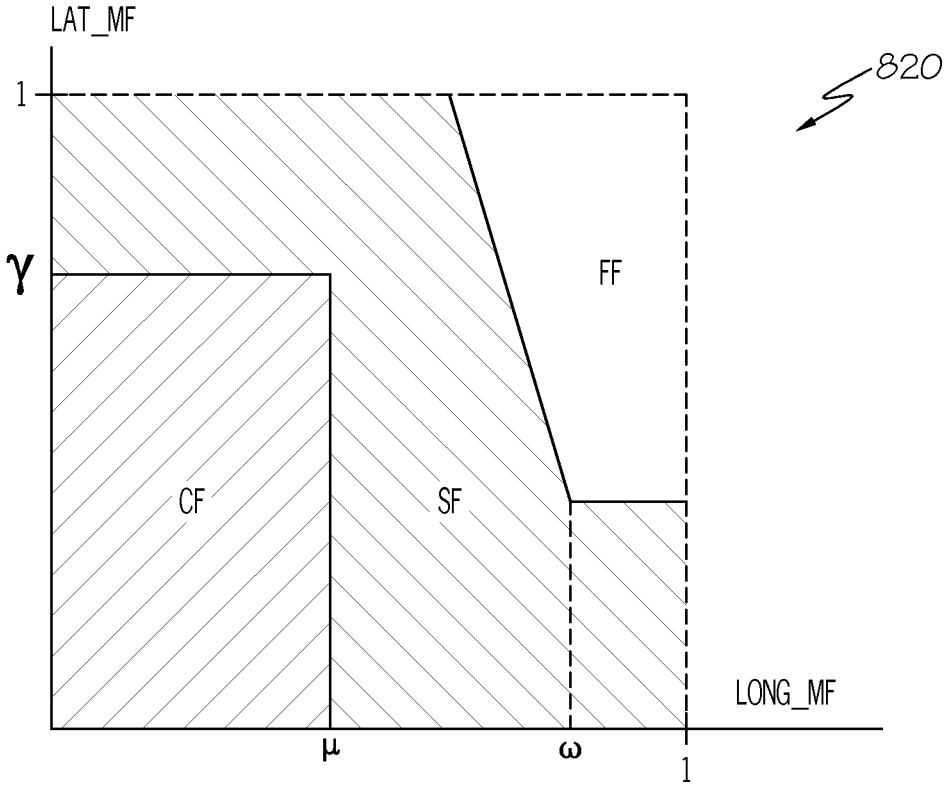

One should note that the examples discussed with regard to FIGS. 6A-6C and FIG. 7 are merely exemplary. More specifically, other calculations may be performed to determine the mobility factors, as well as the congestion level. FIGS. 8A-8C illustrate another exemplary embodiment for these determinations.

FIGS. 8A-8C depict another exemplary embodiment for determining traffic congestion, according to embodiments disclosed herein. More specifically, referring first to FIG. 8A, a probe vehicle 800*a* may be traveling on a four lane roadway (with two lanes traveling each direction). Also within the sensing range of the probe vehicle 800*a* are vehicle 800*b* and vehicle 800*c*, with a distance between the vehicles 800*b* and 800*c* being D23. Additionally, the probe vehicle 800*a* may be configured to determine the relative speed of the vehicles 800*b* and 800*c* to determine whether D23 is increasing, decreasing, or staying the same. Accordingly, if the velocity of vehicle 800*b* (vel_2) and the velocity of vehicle 800*c* (vel_3) is greater than the velocity of the probe vehicle 800*a* (vel_1), the lateral mobility factor may be determined to be D23 divided by the relative velocity of the vehicle 800*c* and the probe vehicle 800*a*, or:

if min(vel_2, vel_3) > vel_1, $$LateralMobilityComponent = \frac{D23}{RelativeVelocity(3, 1)}.$$

In such a situation, the side gap illustrated in FIG. 8A is closing behind.

Similarly, a determination can be made regarding whether the maximum of the velocity of the vehicle 800*b* and the velocity of the vehicle 800*c* is less than the velocity of the probe vehicle 800*a*. In such a situation, the lateral mobility component may be determined to be D23 divided by the relative velocity of the vehicle 800*b* and the probe vehicle 800*a*, or:

$$elseif\ \max(vel_2, vel_3) < vel_1$$

$$LateralMobilityComponent = \frac{D23}{RelativeVelocity(2, 1)}.$$

In such a situation, the side gap in FIG. 8A is closing ahead.

A determination may also be made regarding whether the velocity of the vehicle 800*b* is greater than the velocity of the velocity of the probe vehicle 800*a*, and whether the velocity of the vehicle 800*c* is less than or equal to the velocity of the probe vehicle 800*a*. If so, the lateral mobility factor may be set equal to 1, or:

$$elseif(vel_2 \geq vel_1, vel_3 \leq vel_1)$$

$$LateralMobilityComponent = 1.$$

In this situation, the side gap is open, thus allowing the probe vehicle to change lanes, without encountering either of the vehicles 800*b*, 800*c*.

A determination may also be made regarding whether the velocity of the vehicle 800*b* is less than or equal to the velocity of the probe vehicle 800*a* and whether the velocity of the vehicle 800*c* is greater than the velocity of the probe vehicle 800*a*. If so, the lateral mobility factor may be set equal to zero, or:

elseif(vel__2≤vel__1, vel_3≥vel_1)LateralMobility-Component=0

In such a situation, the side gap in FIG. 8A is closed.

It should be understood that the algorithm described with respect to FIG. 8A may be utilized in FIG. 6B to determine the lateral mobility factor. Additionally, while not explicitly shown if FIG. 8A, in situations where there is more than one lateral gap, a similar calculation may be performed for each lateral gap, with the average being taken as the lateral mobility factor.

Referring now to FIG. 8B, a probe vehicle 802*a* may be traveling behind a vehicle 802*b* at a distance of H21 and in front of a vehicle 802*c*, at a distance of H13. In this embodiment, a longitudinal mobility factor may be determined. As an example, a determination can be made regarding whether the current velocity of the probe vehicle 802*a* is greater than or equal to the desired velocity (vel_des) and whether the gap H21 is greater than the desired gap (h_des). If so, there is little restriction to speed of the probe vehicle 802*a* and thus, the longitudinal mobility factor can be set equal to 1, or:

if(vel__1≥vel_des,*H*21>*H*_des LongitudinalMobility-Factor=1

Similarly, a determination can be made regarding whether the velocity of the probe vehicle 802*a* is greater than a velocity saturation, which is a minimum velocity that the user will tolerate (vel_sat) and whether the velocity of the probe vehicle 802*a* is less than or equal to the desired velocity; and whether H21 is greater than a desired gap distance. If so, the longitudinal mobility factor can be set to 1 minus the desired velocity, minus the velocity of the probe vehicle 802*a*, divided by the velocity saturation, or:

$$elseif(vel_sat \leq vel_1 \leq vel_des, H21 \geq H_des)$$

$$LongitudinalMobilityFactor = 1 - \frac{(vel_des - vel_1)}{vel_sat}.$$

Additionally, a determination can be made regarding whether the headway gap H21 is greater than or equal to the user headway saturation (h_sat) and less than or equal to a desired headway gap; and whether the current velocity of the probe vehicle is greater than or equal to the desired velocity. If so, the longitudinal mobility factor can be set equal to 1 minus the desired headway gap minus H21, divided by the minimum tolerable headway gap, or:

$$elseif(H_sat \leq H21 \leq H_des, vel_1 \geq vel_des)$$

$$LongitudinalMobilityFactor = 1 - \frac{H_des - H21}{H_sat}.$$

An additional calculation may be performed regarding whether the headway gap H21 is between the headway saturation and the desired headway, as well as whether the velocity of the probe vehicle 802*a* is between velocity saturation and the desired velocity. If so, the longitudinal mobility factor may equal the minimum of 1 minus the desired velocity minus the current velocity of the probe vehicle, divided by the velocity saturation and 1 minus the desired headway minus the headway H21, divided by the headway saturation, or:

$$elseif(H_sat \leq H21 \leq H_des, vel_sat \leq vel_1 \leq vel_des)$$

$$LongitudinalMobilityFactor = \min\left(\left(1 - \frac{vel_des - vel_1}{vel_sat}\right), \left(1 - \frac{H_des - H21}{H_sat}\right)\right).$$

Further, a determination can be made whether the current velocity of the probe vehicle 802*a* is less than or equal to the velocity saturation or whether H21 is less than the headway saturation. If so, the longitudinal mobility factor may be set equal to zero, or:

elseif(vel__1≤vel_sat·*H*21<*H*_sat)LongitudinalMobilityFactor=0

Referring now to FIG. 8C, once the lateral mobility factor and the longitudinal mobility factor are determined, a congestion level may be determined, such as using a graph 820. While the graph 700 from FIG. 7 illustrates rectangular areas for congested flow and synchronized flow, the graph 820 is included to emphasize that other calculations may be made. More specifically, in the graph 820, congested flow is a rectangular area, with the predetermined threshold of λ as the height and the predetermined threshold of μ as the width. Similarly, synchronized flow may be an irregular shape, and free flow may be the remaining area between the maximums for the lateral mobility factor and the longitudinal mobility factor.

While particular embodiments and aspects of the present disclosure have been illustrated and described herein, various other changes and modifications can be made without departing from the spirit and scope of the disclosure. Moreover, although various aspects have been described herein, such aspects need not be utilized in combination. Accordingly, it is therefore intended that the appended claims cover all such changes and modifications that are within the scope of the embodiments shown and described herein.

It should now be understood that embodiments disclosed herein may include systems, methods, and non-transitory computer-readable mediums for determination of local traffic flow by probe vehicles. As discussed above, such embodiments may be configured to determine desired driving conditions, as well as lateral and longitudinal spacing on a roadway to determine a traffic condition. This information may additionally be transmitted to other vehicles. It should also be understood that these embodiments are merely exemplary and are not intended to limit the scope of this disclosure.

What is claimed is:

1. A method for estimating local traffic flow, comprising steps of:

determining, by a vehicle computing device of a vehicle, a driving habit of a user from historical data, wherein the driving habit includes a headway gap the user prefers and a preferred lateral gap that the user prefers in order to change lanes, wherein the headway gap that the user prefers is combined with a speed gap to determine a longitudinal mobility factor, wherein the speed gap is a function of a speed the user prefers and a current vehicle speed;

determining, by the vehicle computing device, a current location of the vehicle that the user is driving;

determining, by the vehicle computing device, a current driving condition for the vehicle;

predicting by the vehicle computing device, a desired driving condition from the driving habit and the current location;

comparing, by the vehicle computing device, the desired driving condition with the current driving condition to determine a traffic congestion level; and sending a signal, by the vehicle computing device, to a different vehicle that will enter the current location of the vehicle, wherein the signal indicates the traffic congestion level.

2. The method of claim 1, wherein the driving habit additionally includes at least one of the following: the speed the user prefers to drive and a lateral gap the user prefers in order to change lanes.

3. The method of claim 1, wherein the current driving condition of the vehicle includes at least one of the following: the current vehicle speed, a current headway gap, a current lateral gap.

4. The method of claim 1, wherein comparing the desired driving condition with the current driving condition includes:

determining whether the current driving condition is different than the desired driving condition;

in response to determining that the current driving condition is different than the desired driving condition, determining an amount that the current driving condition is different than the desired driving condition; and comparing the amount that the current driving condition is different than the desired driving condition to a predetermined threshold to determine the traffic congestion level.

5. The method of claim 1, wherein determining the current driving condition includes calculating a lateral mobility factor.

6. The method of claim 1, wherein determining the traffic congestion level includes:

calculating a lateral mobility factor; and determining the traffic congestion level from a comparison of the lateral mobility factor and the longitudinal mobility factor.

7. A system for estimating local traffic flow, comprising:

a processing component; and a memory component, at a vehicle that a user is driving, that stores vehicle environment logic that, when executed by the processing component, causes a vehicle computing device to perform at least the following:

determine a driving habit of the user from historical data, wherein the driving habit comprises a preferred headway gap the user prefers and a preferred lateral gap that the user prefers in order to change lanes, wherein the headway gap that the user prefers is combined with a speed gap to determine a longitudinal mobility factor, wherein the speed gap is a function of a speed the user prefers and a current vehicle speed;

determine a current location of the vehicle;

determine a current driving condition for the vehicle;

predict a desired driving condition from driving habit and the current location;

compare the desired driving condition with the current driving condition to determine a traffic congestion level; and send a signal from the vehicle to a different vehicle that will enter the current location of the vehicle, wherein the signal indicates the traffic congestion level.

8. The system of claim 7, wherein the driving habit additionally includes the speed the user prefers to drive.

9. The system of claim 7, wherein the current driving condition of the vehicle includes at least one of the following: the current vehicle speed, a current headway gap, and a current lateral gap.

10. The system of claim 7, wherein comparing the desired driving condition with the current driving condition includes:

determining whether the current driving condition is different than the desired driving condition;

in response to determining that the current driving condition is different than the desired driving condition, determining an amount that the current driving condition is different than the desired driving condition; and comparing the amount that the current driving condition is different than the desired driving condition to a predetermined threshold to determine the traffic congestion level.

11. The system of claim 7, wherein determining the current driving condition includes calculating a lateral mobility factor.

12. A non-transitory computer-readable medium for estimating local traffic flow, the non-transitory computer-readable medium storing a program that, when executed by a vehicle computing device at a vehicle a user is driving, causes the vehicle computing device to perform at least the following:

determine a driving habit of the user from historical data, wherein the driving habit includes a lateral gap the user prefers in order to change lanes, wherein the lateral gap that the user prefers is utilized to determine a lateral mobility factor, wherein the lateral mobility component is a function of a current gap duration and desired gap duration;

determine a current location of the vehicle;

determine a current driving condition for the vehicle;

predict a desired driving condition from the driving habit and the current location;

compare the desired driving condition with the current driving condition to determine a traffic congestion level; and send a signal from the vehicle to a different vehicle that will enter the current location of the vehicle, wherein the signal indicates the traffic congestion level.

13. The non-transitory computer-readable medium of claim 12, wherein the driving habit additionally includes at least one of the following: a speed the user prefers to drive and a headway gap the user prefers.

14. The non-transitory computer-readable medium of claim 12, wherein the current driving condition of the vehicle includes at least one of the following: a current vehicle speed, a current headway gap, and a current lateral gap.

15. The non-transitory computer-readable medium of claim 12, wherein comparing the desired driving condition with the current driving condition includes:

determining whether the current driving condition is different than the desired driving condition;

in response to determining that the current driving condition is different than the desired driving condition, determining an amount that the current driving condition is different than the desired driving condition; and comparing the amount that the current driving condition is different than the desired driving condition to a predetermined threshold to determine the traffic congestion level.

16. The non-transitory computer-readable medium of claim 12, wherein determining the current driving condition includes calculating a longitudinal mobility factor.

17. The non-transitory computer-readable medium of claim 12, wherein determining the traffic congestion level includes:

calculating a longitudinal mobility factor; and determining the traffic congestion level from a comparison of the lateral mobility factor and the longitudinal mobility factor.

18. The method of claim 1, wherein the longitudinal mobility factor includes a spacing error that is a function of a current headway gap and a vehicle length.

19. The system of claim 7, wherein the longitudinal mobility factor includes a spacing error that is a function of a current headway gap and a vehicle length.

20. The non-transitory computer-readable medium of claim 12, wherein the lateral mobility factor includes a combination of a plurality of lane change gaps.

* * * * *

UNITED STATES PATENT AND TRADEMARK OFFICE

CERTIFICATE OF CORRECTION

PATENT NO. : 8,897,948 B2
APPLICATION NO. : 12/890751
DATED : November 25, 2014
INVENTOR(S) : Caveney et al.

It is certified that error appears in the above-identified patent and that said Letters Patent is hereby corrected as shown below:

Title Page, item (73),

Assignee, Page 1 add "Motor Engineering & Manufacturing North America, Inc." after "Toyota"

Signed and Sealed this
Twentieth Day of October, 2015

Michelle K. Lee

Michelle K. Lee
*Director of the United States Patent and Trademark Office*